US008631526B2

(12) United States Patent
Janicek et al.

(10) Patent No.: US 8,631,526 B2
(45) Date of Patent: Jan. 21, 2014

(54) METHOD FOR CONTROL OF CENTRIFUGATION PROCESS IN WASHING MACHINE

(71) Applicants: Milan Janicek, Odry (CZ); Zuzana Vasickova, Ostrava-Hrabuvka (CZ); Pavel Stepan, Piskovice (CZ)

(72) Inventors: Milan Janicek, Odry (CZ); Zuzana Vasickova, Ostrava-Hrabuvka (CZ); Pavel Stepan, Piskovice (CZ)

( * ) Notice: Subject to any disclaimer, the term of this patent is extended or adjusted under 35 U.S.C. 154(b) by 0 days.

(21) Appl. No.: 13/753,110

(22) Filed: Jan. 29, 2013

(65) Prior Publication Data

US 2013/0247305 A1 Sep. 26, 2013

(30) Foreign Application Priority Data

Mar. 21, 2012 (EP) ..... 12466006

(51) Int. Cl.
*D06F 35/00* (2006.01)

(52) U.S. Cl.
USPC ..... 8/158; 68/12.06; 68/23.2; 68/23.1; 68/23 R; 8/159; 8/137; 74/572.4; 210/144

(58) Field of Classification Search
USPC ..... 68/12.06, 12.04, 3 R, 23 R, 23 A, 19.2; 8/158, 159; 210/144, 781, 787, 360.1; 74/572.4, 573.1, 572.2; 134/33, 87
See application file for complete search history.

(56) References Cited

U.S. PATENT DOCUMENTS

| | | | | |
|---|---|---|---|---|
| 5,070,565 | A * | 12/1991 | Sood et al. | 8/159 |
| 2005/0016227 | A1* | 1/2005 | Lee | 68/12.04 |
| 2008/0163435 | A1 | 7/2008 | Lee | 8/159 |
| 2010/0306926 | A1* | 12/2010 | Altinier et al. | 8/137 |
| 2012/0024016 | A1* | 2/2012 | Dunn et al. | 68/12.27 |

FOREIGN PATENT DOCUMENTS

| | | | |
|---|---|---|---|
| EP | 0 732 437 | A1 | 9/1996 |
| EP | 0 763 618 | A2 | 3/1997 |
| EP | 1 167 609 | A1 | 1/2002 |
| EP | 1 760 181 | A1 | 3/2007 |
| JP | 2009-77748 | | 4/2009 |
| WO | WO 2007/134926 | A1 | 11/2007 |
| WO | WO 2008/075987 | A2 | 6/2008 |

OTHER PUBLICATIONS

Search Report with a date of completion of Sep. 7, 2012 issued in corresponding European Patent Application No. EP 12 46 6006.

* cited by examiner

*Primary Examiner* — Michael Barr
*Assistant Examiner* — Thomas Bucci
(74) *Attorney, Agent, or Firm* — Ostrolenk Faber LLP

(57) ABSTRACT

Method for controlling the centrifugation process of a washing machine, wherein during a first, a second and a third laundry distribution phases (D1, D2, D3), performing a number of unbalance value measurements (M1-M7) and comprising an unbalance value of the drum of the washing machine with predetermined unbalance values. If the current unbalance values are within predetermined intervals, the washing machine performs a spin phase (S1, S2, Smax). If the values are not within the predetermined intervals, the washing machine performs a laundry redistribution phase (R1, R2), after which a further laundry distribution phase (D1, D3) may take place.

1 Claim, 3 Drawing Sheets

METHOD FOR CONTROL OF CENTRIFUGATION PROCESS IN WASHING MACHINE

BACKGROUND OF THE INVENTION

The invention concerns the method for control of centrifugation process in a washing machine.

STATE OF THE ART

If in a horizontally loaded washing machine the laundry is spreaded uniformly, or if a washing machine is running idle, the load of the engine will be also uniform. Contrary to that, non-uniform load of a drum of a washing machine causes non-uniform load of the engine, thus an oscillation of load of the engine because of the unbalance, which appears in a torque component of electric current Iq of the engine. Electric current Iq loads the engine non-uniformly, causes heating over and declines it's service life.

In EP 1 167 609 a method for detection and control of dynamic unbalance of a drum of a washing machine is presented. In the first period "A" turning speed of the drum is increased from zero up to 50 r/s. In the second period "B"—which is called a laundry distribution, turning speed is increased up to 100 r/s. During that period the laundry is pressed to the wall of the washing drum without possibility to fall down because of centrifugal force. Mostly, the third period "C" follows, wherein appearance of unbalance is more frequent. Unbalance value is checked on the basis of changes of turning speed and torque force of the engine. In the end of that period the unbalance value is evaluated, whether it is within a preset interval. If not a new distribution of the laundry is necessary. If the unbalance value is not over the predetermined interval, another slow increasing of rotation speed follows. During it the unbalance value is measured again and subsequently evaluated. Afterward, a centrifugation process follows. Such centrifugation process does not offer, in case of finding of unbalance of a drum of a washing machine another solution, than the termination of the centrifugation process.

In EP 0 763 618 a start up process of a washing machine to the centrifugation turning speed is presented, which comprises a sequence of measurements of speed, acceleration and unbalance deviation. First measurement is made after acceleration of rotary speed of a drum up to 70 r/s. After the period of constant speed and after it's finish the measurement is done again. If the measured values are within of a predetermined interval the rotary speed will be increased together with simultaneously realised checking measurements. Rotation is finished after expiration of centrifugation's time. Also such centrifugation process does not offer, in case of finding of unbalance of a drum of a washing machine another solution, than the termination of the centrifugation process.

In JP 2009077748 a detection method of unbalance of a washing machine is presented, where vibrations are monitored during the centrifugation process of a washing machine, thus at time of constant high rotary speed. However, measurement of unbalance at time of high rotary speed is not exact and in many cases it is too late to prevent damaging of the washing machine.

In WO 2007/134926 a measurement of unbalance of a drum of a washing machine is presented. Rotary speed is increased to distribution speed, during which laundry is uniformly spread over the inner surface of the washing machine by centrifugal force. Afterwards the measurement starts and there is a comparison of unbalance between at least two of four points on the drum of the washing machine. In case the measured values are within of the predetermined interval, rotary speed of the drum is increased to the centrifugation rotary speed. However, absence of a multi-step centrifugation causes imperfect centrifugation of laundry, thus it is insufficiently dried.

In WO 2008/075987 a measurement method of unbalance of a drum of a washing machine is presented, where first scanning of unbalance is realized after increase of rotary speed up to 50 r/s. If the measured value of unbalance is within the range of the predetermined interval, the drum of the washing machine changes to the low rotary speed, where the value of unbalance is measured again, or there is an increase directly to the centrifugation rotary speed. Such method has not a multi-step centrifugation, which would divide laundry distribution to more stages and which would create better conditions for its uniform spreading in the inner space of the drum.

The aim of the present invention is to present such method for control of the centrifugation process in a washing machine, which would ebolish the above mentioned disadvantages and would enable high-quality centrifugation.

FEATURE OF THE INVENTION

The above mentioned disadvantages are considerably eliminated by method for control of centrifugation process in a washing machine, where the first step consists in a laundry distribution in the drum of the washing machine, during which at last one measurement of unbalance of the drum is done, according to the invention, wherein during the first laundry distribution the first measurement is proceeded and subsequently, the measured unbalance value of the drum of the washing machine is compared with the predetermined intervals of the unbalance, when if the current unbalance value is within the predetermined intervals, the washing machine switches to the first spin and subsequently to the first redistribution, after which the second distribution follows, or if the value is not within the predetermined intervals the washing machine switches directly to the first laundry redistribution, after which also the second laundry distribution takes place, whereas during the second laundry distribution the second measurement is proceeded and subsequently the measured unbalance value is compared with the predetermined unbalance intervals when, if the actual unbalance value is within the range of the predetermined intervals the washing machine switches to the second spin, subsequently the second laundry redistribution follows and subsequently the third laundry distribution follows, or if the actual unbalance value is not within the range of the predetermined interval the third measurement is done, afterwards the measured unbalance value of the washing machine is compared with the predetermined unbalance intervals, when, if the actual unbalance value is within the range of the predetermined intervals the washing machine switches to the second spin, subsequently the second laundry redistribution follows and subsequently the third laundry distribution follows, or if the value is not within the range of the predetermined interval the fourth measurement is done, subsequently the measured unbalance value of the washing machine is compared with the predetermined unbalance intervals, when, if the actual unbalance value is within the range of the predetermined intervals the washing machine switches to the second spin, subsequently the second laundry redistribution follows and subsequently the third laundry distribution follows, or if the value is not within the range of the predetermined interval the washing machine switches directly to the second laundry redistribution, followed by the third laundry distribution, whereas during the third laundry distribution the fifth measurement is proceeded, subsequently the measured unbalance value is compared with the predetermined unbalance interval, when, if the actual unbalance value is within the range of the predetermined interval the washing machine switches to the high rotary spin, or if the actual unbalance value is not within the range of the predetermined interval the additional sixth measurement is proceeded, subsequently the measured unbalance value of the drum of the washing machine is compared with the predetermined unbalance intervals, when, if the actual unbalance value is within the range of the predetermined intervals the washing machine switches to the high speed spin, or if the value is not within the range of the predetermined intervals the seventh measurement is proceeded, subsequently measured unbalance value of the washing machine is compared with the predetermined unbalance interval, when, if the actual unbalance value is within the range of the predetermined intervals of the unbalance the washing machine switches to the high speed spin, or if the actual unbalance value is higher than the maximum allowed value of unbalance, the washing machine switches back to the second laundry redistribution, and the whole process of the third distribution follows, whereas if the unbalance value of the drum of the washing machine is not decreased neither after the seventh unbalance measurement of the second performance of the third distribution follows, the washing machine changes again to the second redistribution and the whole process of the third distribution, whereas if the unbalance value of the drum of the washing machine is not decreased neither after the seventh unbalance measurement of the third performance of the third distribution, the washing machine changes to the low rotary speed spin, or the washing machine changes to the washing rotary speed.

DESCRIPTION OF THE DRAWINGS

The invention will be further explained by use of drawings, in which.

PREFERRED EMBODIMENTS OF THE INVENTION

Detection of a laundry distribution in a washing machine is the most important step before the change to the high centrifugation rotary speed. Detection of an unbalance value of the drum of the washing machine is proceeded before each change to the high centrifugation rotary speed, because determination of the unbalance value is more accurate just during the low rotary speed of the drum of the washing machine. Measurement of unbalance before acceleration to the rotary speed of the drum is advantageous also, because the distribution process takes place during it. The unbalance value is gained during the distribution process of laundry during few short time intervals. If the unbalance value is within the range of the predetermined intervals, laundry distribution will be terminated and the washing machine can switch to the high rotary speed, called the spin. If the unbalance value in the end of the distribution process is still higher than the predetermined interval, the unbalance value will be compared and it will be decided, in which of the predetermined intervals the actual unbalance value belongs. Those intervals has been set by experimental measurements before. According to that in which interval the measured value belongs, the value of the rotary speed is either decreased or the process is terminated and the laundry redistribution will take place. The laundry redistribution contains more, in the present case there are three, fast changes of the turning directions of the drum of the washing machine, which causes dropping of laundry from the wall of the drum, so laundry is better prepared for the next process of laundry distribution.

Figure 1:
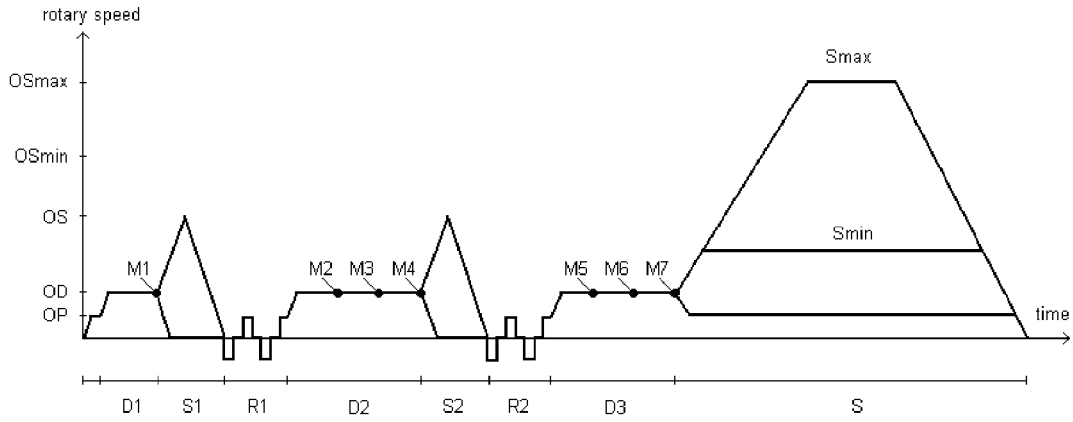
FIG. 1 presents a time-line diagram of rotary speed of a drum of a washing machine during the centrifugation of laundry, according to the invention.

The method for control of the centrifugation process in the washing machine, according to the invention, it means centrifugation of laundry, is presented in FIG. 1 and is described as follows:

After the end of the rinse process and cease of turns of the drum, a valve for draining water is opened and the washing machine changes to the washing rotary speed OP and afterwards to the distribution rotary speed OD. The first laundry distribution D1 takes 20 seconds. At the end of it the first measurement M1 of unbalance is proceeded, and the current unbalance value, which is caused by laundry rotation in the drum of the washing machine, is red by a frequency transmuter. If the unbalance value is within the range of the predetermined intervals, the rotary speed changes up to the first spin S1, where the rotary speed of the drum is rapidly increased up to the predetermined speed OS of the spin S1, and afterwards the rotary speed is decreased to zero. After the first spin S1 the first redistribution R1 is realised and subsequently the second laundry distribution D2, which takes fifthteen-seconds, is realised. If unbalance is not within the range of the predetermined intervals, the spin S1 is skipped and the first laundry redistribution R1 follows.

Figure 2:
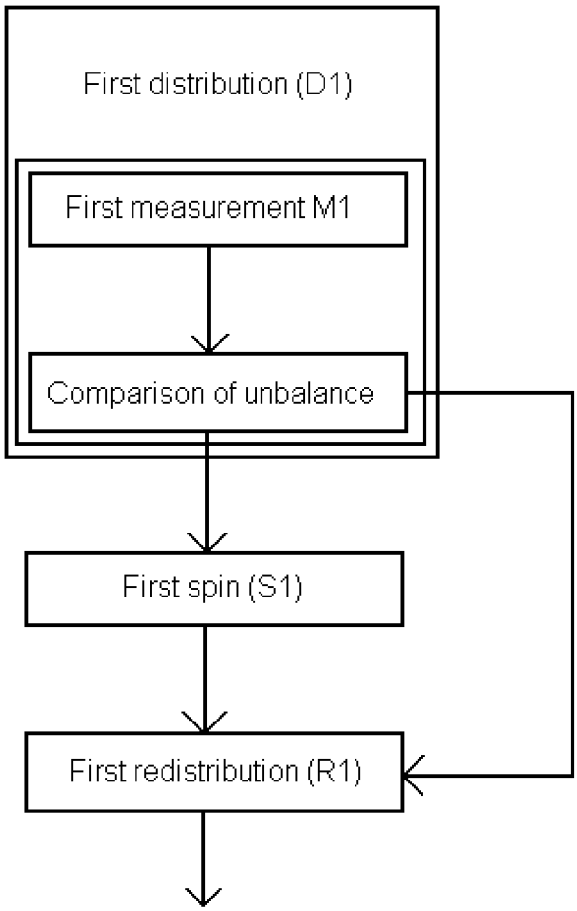
FIG. 2 presents the first part of the process-diagram of the centrifugation process presented in FIG. 1.

In FIG. 2 above mentioned process is illustrated by a process-diagram, which presents the sequence of individual steps of the centrifugation process of the washing machine. As it is obvious from the figure, after the first laundry distribution D1 the first measurement M1 is proceeded and afterwards, the measured unbalance value of the drum of the washing machine is compared with the predetermined intervals of the unbalance. If the current unbalance value is within the predetermined intervals, the washing machine switches to the first spin S1 and subsequently to the first redistribution R1, after which the second distribution D2 follows. If the value is not within the predetermined intervals the washing machine switches directly to the first laundry redistribution R1, after which also the second laundry distribution D2 comes.

During the second laundry distribution D2 the second measurement M2 of unbalance is proceeded after five seconds from its beginning. When unbalance was registered, the second laundry distribution D2 continues for next five seconds followed by third unbalance measurement M3. When another unbalance is registered the second laundry distribution D2 continues for next five seconds followed by fourth unbalance measurement M4. If the actual unbalance value after fourth measurement M4 is within the range of the predetermined interval, the washing machine switches to the second spin S2, thus to the rotary speed OS of the spin S2, and subsequently to the third laundry distribution D3. If the unbalance value is not within the range of the predetermined intervals, the second spin S2 is skipped and the second laundry redistribution R2 follows directly.

Figure 3:
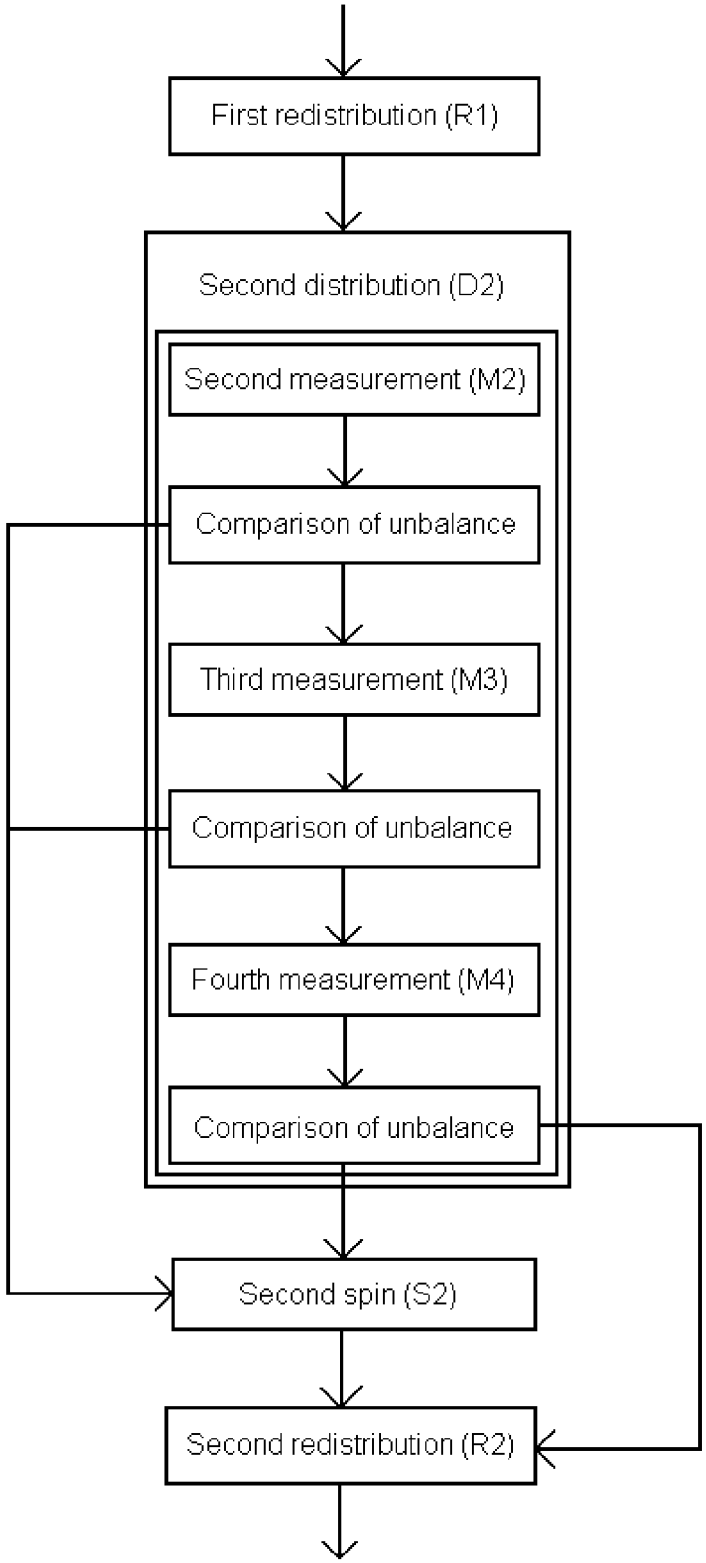
FIG. 3 presents the second part of the process-diagram of the centrifugation process presented in FIG. 1

In FIG. 3 above mentioned process is illustrated by process-diagram, which presents the sequence of individual steps of the centrifugation process of the washing machine.

As it is obvious from the figure, during the second laundry distribution D2 the second measurement M2 is proceeded and afterwards the measured unbalance value is compared with the predetermined unbalance intervals. If the actual unbalance value is within the range of the predetermined intervals the washing machine switches to the second spin S2, subsequently the second laundry redistribution R2 follows and subsequently the third laundry distribution D3 follows. If the actual unbalance value is not within the range of the predetermined interval the third measurement M3 is done, afterwards the measured unbalance value of the washing machine is compared with the predetermined unbalance intervals. If the actual unbalance value is within the range of the predeterminet interval the washing machine switches to the second spin S2, afterward to the second laundry redistribution R2 and afterwards the third laundry distribution D3 follows. If the value is not within the range of the predetermined interval the fourth measurement M4 is done, afterwards the measured unbalance value of the washing machine is compared with the predetermined unbalance intervals. If the actual unbalance value is within the range of the predetermined intervals the washing machine switches to the second spin S2, followed by the second laundry redistribution R2 and subsequently the third laundry distribution D3 follows. If the value is not within the range of the predetermined interval the washing machine switches directly to the second laundry redistribution R2, followed by the third laundry distribution D3.

During the third laundry distribution D3 the fifth measurement M5 of the unbalance is proceeded after five seconds from its beginning. When unbalance was registered the third laundry distribution D3 continues for next five seconds and is followed by sixth unbalance measurement M6. When another unbalance was registered the third laundry distribution D3 continues for next five seconds and it is finished by seventh unbalance measurement M7. If the unbalance value of the drum of the washing machine is not decreased neither after the seventh unbalance measurement M7, the washing machine changes again to the second laundry redistribution R2 and the whole process of the third distribution D3, which contains the measurement M5, M6 and M7, is repeated. If the unbalance value of the drum of the washing machine is not decreased neither after the seventh unbalance measurement M7 of the second performance of the third distribution D3, the washing machine changes again to the second laundry redistribution R2 and the whole process of the third distribution D3, which contains the measurement M5, M6 and M7, is repeated. If the unbalance value of the drum of the washing machine is not decreased neither after the seventh unbalance measurement M7 of third performance of the third distribution D3, the washing machine changes to the low rotary speed OSmin. The value of the low rotary speed OSmin depends on the value of measured unbalance. If the unbalance value is too high, the washing machine changes to the washing rotary speed OP. If the actual unbalance value is within the range of the optimal unbalance intervals, the washing machine changes to the high rotary speed OSmax.

Figure 4:
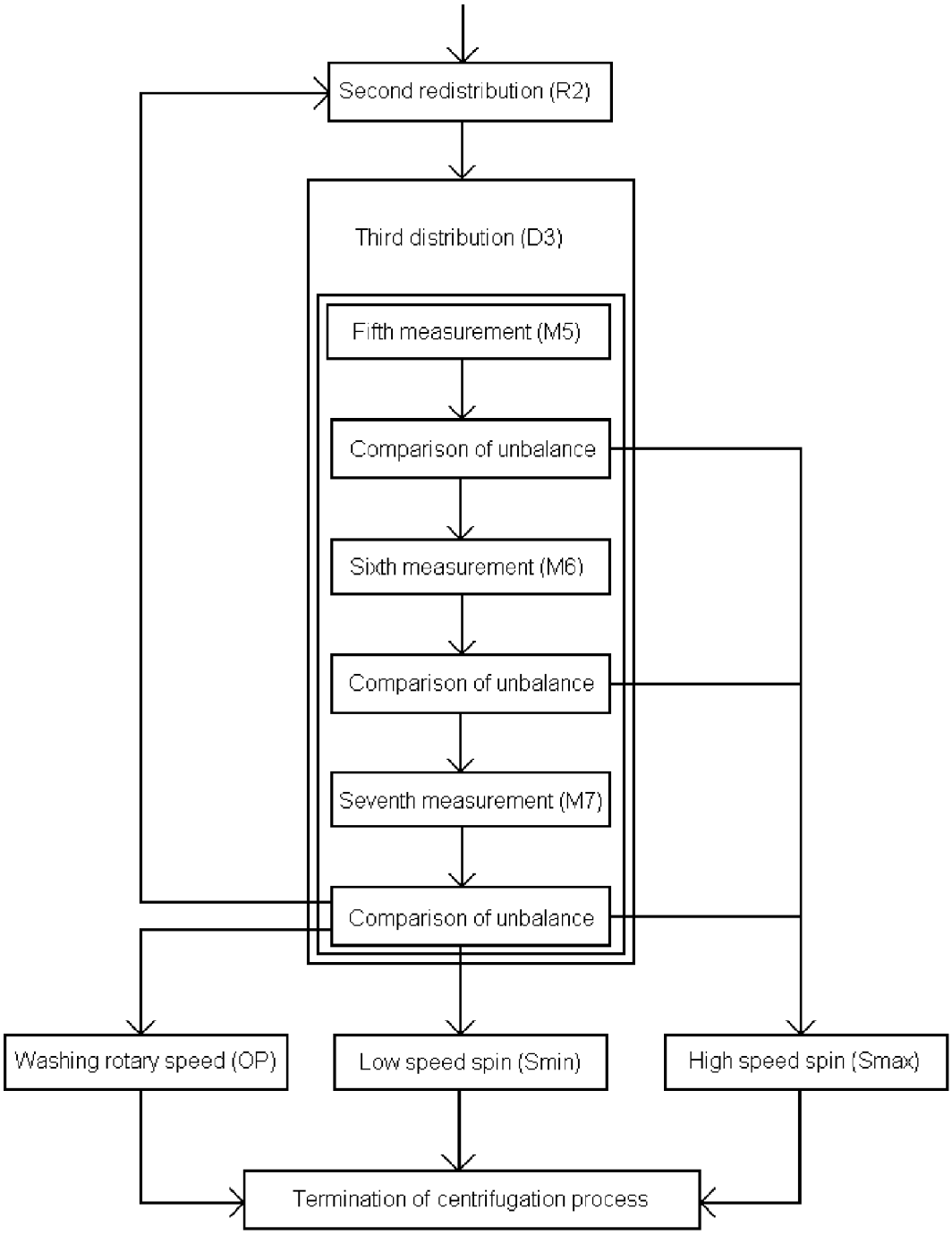
FIG. 4 presents the third part of the process-diagram of the centrifugation process presented in FIG. 1.

In FIG. 4 above mentioned process is illustrated by process-diagram, which presents a sequence of individual steps of the centrifugation process of the washing machine. As it is obvious from the figure, during the third laundry distribution D3 the fifth measurement M5 is proceeded, subsequently the measured unbalance value is compared with the predetermined unbalance interval. If the actual unbalance value is within the range of the predetermined interval the washing machine switches to the high speed spin Smax, which is the last part of the centrifugation. If the actual unbalance value is not within the range of the predetermined interval the additional sixth unbalance measurement M6 is proceeded, subsequently the measured unbalance value of the drum of the washing machine is compared with the predetermined unbalance intervals. If the actual unbalance value is within the range of the predetermined interval the washing machine switches to the high speed spin Smax. If the value is not within the range of the predetermined intervals the seventh unbalance measurement M7 is proceeded, subsequently measured unbalance value of the washing machine is compared with the predetermined unbalance interval. If the actual unbalance value is within the range of the predetermined intervals of the unbalance the washing machine switches to the high speed spin Smax. If the actual unbalance value is higher than the maximum allowed value of unbalance, the washing machine switches back to the second laundry redistribution R2, and the whole process of the third distribution D3, which contains the measurement M5, M6 and M7, is repeated. If the unbalance value of the drum of the washing machine is not decreased neither after the seventh unbalance measurement M7 of the second performance of the third distribution D3, the washing machine changes again to the second redistribution R2 and the whole process of the third distribution D3, which contains the measurements M5, M6 and M7, is repeated. If the unbalance value of the drum of the washing machine is not decreased neither after the seventh unbalance measurement M7 of the third performance of the third distribution D3, the washing machine changes to the low rotary speed spin Smin. The value of low rotary speed spin Smin depends on the value of the measured unbalance. If the unbalance value is too high, the washing machine changes to the washing rotary speed OP.

The invention claimed is:

1. A method for control of a centrifugation process in a washing machine, comprising:

distributing laundry in a drum of the washing machine, during the distribution, first measuring at least one unbalance of the drum during the first step of laundry distribution after the first measurement, subsequently comparing the measured unbalance value of the drum of the washing machine with predetermined intervals of the unbalance, and if the current unbalance value is within the predetermined intervals, switching the washing machine to a first spin and subsequently to a first laundry redistribution, and then to a second distribution, or if the current unbalance value is not within the predetermined intervals, switching the washing machine directly to the first laundry redistribution and then to a second laundry distribution;

during the second laundry distribution, performing a second measurement and subsequently comparing the measured unbalance value within the predetermined unbalance intervals and, if the actual unbalance value is within the range of the predetermined intervals, switching the washing machine to a second spin and subsequently to the second laundry redistribution, and then to a third laundry distribution;

or if the actual unbalance value is not within the range of the predetermined intervals, performing a third measurement and then comparing the measured unbalance value of the washing machine with the predetermined unbalance intervals, and if the actual unbalance value is within the range of the predetermined intervals, switching the washing machine to the second spin and then to the second laundry redistribution and then to the third laundry distribution;

or if the actual unbalance value is not within the range of the predetermined interval, performing a fourth measurement and comparing the measured unbalance value of the washing machine with the predetermined unbalance intervals, and if the actual unbalance value is within the range of the predetermined intervals, switching the washing machine to a second spin, subsequently to a second laundry redistribution and then to a third laundry distribution;

or if the actual unbalance value is not within the range of the predetermined intervals, switching the washing machine directly to the second laundry redistribution and then to the third laundry distribution;

during the third laundry distribution, performing a fifth measurement, then comparing the measured unbalance value with the predetermined unbalance interval, if the actual unbalance value is within the range of the predetermined interval, switching the washing machine to the high speed spin;

or if the actual unbalance value is not within the range of the predetermined interval, performing an additional sixth measurement, then comparing the measured unbalance value of the drum of the washing machine with the predetermined unbalance intervals, and if the actual unbalance value is within the range of the predetermined intervals, switching the washing machine to the high speed spin;

or if the actual value is not within the range of the predetermined intervals, performing a seventh measurement, and then comparing the unbalance value of the washing machine with the predetermined unbalance interval, if the actual unbalance value is within the range of the predetermined intervals of the unbalance, switching the washing machine to the high speed spin;

or if the actual unbalance value is higher than the maximum allowed value of unbalance, switching the washing machine back to the second laundry redistribution, and the process of the third distribution, whereas if the unbalance value of the drum of the washing machine is not decreased after the seventh unbalance measurement and after a second performance of the third distribution, changing the washing machine again to the second redistribution followed by the process of the third distribution;

whereas if the unbalance value of the drum of the washing machine is not decreased after the seventh unbalance measurement of the third performance of the third distribution, changing the washing machine to a low rotary speed spin, or the washing machine changes to the washing rotary speed.

* * * * *